US005724708A

United States Patent [19]

Bert

[11] Patent Number: 5,724,708

[45] Date of Patent: Mar. 10, 1998

[54] END CONNECTOR ASSEMBLY FOR WATCHBAND

[75] Inventor: Stephen F. Bert, North Scituate, R.I.

[73] Assignee: Textron, Inc., Providence, R.I.

[21] Appl. No.: 758,726

[22] Filed: Dec. 3, 1996

[51] Int. Cl.[6] ..... A44C 5/18

[52] U.S. Cl. ..... 24/265 B; 24/265 WS; 224/164; 368/282

[58] Field of Search ..... 24/265 WS, 265 B, 24/71 J; 224/180, 164; 59/79.1; 368/281, 282

[56] References Cited

U.S. PATENT DOCUMENTS

| | | | |
|---|---|---|---|
| 2,871,655 | 2/1959 | O'Larte et al. | 24/265 B X |
| 3,675,284 | 7/1972 | Rieth | 24/265 B |
| 3,740,804 | 6/1973 | Levinger | 24/265 B X |
| 3,889,323 | 6/1975 | Reith | 24/265 B |
| 4,375,713 | 3/1983 | Bert et al. | 24/265 WS X |
| 4,624,581 | 11/1986 | Mock et al. . | |
| 4,805,271 | 2/1989 | Ripley . | |
| 4,837,901 | 6/1989 | Bert . | |
| 4,949,433 | 8/1990 | Bert . | |
| 4,958,334 | 9/1990 | Grosjean . | |
| 4,987,655 | 1/1991 | Bert . | |
| 5,090,094 | 2/1992 | Bert . | |
| 5,176,301 | 1/1993 | Bert | 224/164 X |
| 5,272,683 | 12/1993 | Jackl . | |

FOREIGN PATENT DOCUMENTS

| | | | |
|---|---|---|---|
| 552395 | 1/1923 | France | 24/265 WS |
| 251700 | 11/1947 | Switzerland | 24/265 B |
| 703494 | 3/1951 | United Kingdom | 24/71 J |

*Primary Examiner*—Peter M. Cuomo
*Assistant Examiner*—Hanh V. Tran
*Attorney, Agent, or Firm*—Samuels, Gauthier Stevens & Reppert

[57] ABSTRACT

A connector for joining an end of a watchband to a watch case, the end of the watchband having a terminal link and the watch case having first lugs separated by first sockets with first apertures extending through the first lugs. The connector includes metal bottom and top components. The bottom component has a rear end configured to underlie the terminal link of the watchband, and a front end with mutually spaced projections, at least two of which define hollow guides. The top component has a rear end configured to overlie the rear end of the bottom component, and a front end with mutually spaced flanges aligned with and bent around the projections on the bottom component to form second lugs separated by second sockets. The top component is joined to the bottom component with the terminal link of the watchband captured therebetween. The first and second lugs are adapted to be received respectively in the second and first sockets. A pin is axially inserted through the apertures in the lugs of the watch case and the hollow guides of the bottom component to establish a pivotal connection between the watch case and the end connector.

7 Claims, 3 Drawing Sheets

END CONNECTOR ASSEMBLY FOR WATCHBAND

BACKGROUND OF THE INVENTION

1. Field of the Invention

This invention relates to an improved end connector assembly for coupling the ends of an expansible watchband to a watch case molded from a plastic material, such as for example ABS.

2. Description of the Prior Art

As disclosed for example, in U.S. Pat. No. 4,958,334 (Grosjean), it is known to employ end connectors comprising an assembly of top and bottom metal components having a plastic insert interposed therebetween. The watch case and the plastic insert each have spaced lugs which are interengaged in a tongue-and-groove type joint. A metal pin is inserted through aligned apertures in the interengaged lugs to connect the end connector to the watch case. The primary function of the plastic insert is to exert an elastic clamping force on the pin, thereby opposing any tendency of the pin to work its way free.

Problems are encountered when metal watchbands with this type of end connector are subjected to coating processes involving physical vapor deposition ("PVD coatings"). Such processes expose the watchband components to relatively high temperatures on the order of 280°–350° F., causing the plastic insert to outgas, which in turn disrupts the coating process.

SUMMARY OF THE INVENTION

The primary objective of the present invention is to obviate the aforesaid problem by eliminating the plastic insert from the end connector assembly.

A companion objective of the present invention is to provide an all metal end connector assembly capable of securely retaining the connecting pin.

In a preferred embodiment of the invention to be described hereinafter in greater detail, these and other objectives and advantages are achieved by an end connector assembly comprising metal bottom and top components configured and dimensioned to be joined together with only a terminal top link of the watchband securely captured therebetween. The bottom component includes hollow guides which can be aligned axially with apertured lugs on the watch case to receive the metal connecting pin. The bottom component preferably further includes a spring member in resilient contact with the connecting pin.

Advantageously, the hollow guides have reduced diameter portions serving to contact and guide the connecting pin, and enlarged diameter portions around which flanges of the top component are bent during assembly of the top component onto the bottom component.

These and other objects, features and advantages will become more apparent as the description proceeds with reference to the accompanying drawings, wherein:

DETAILED DESCRIPTION OF THE PREFERRED EMBODIMENT

Figure 1:
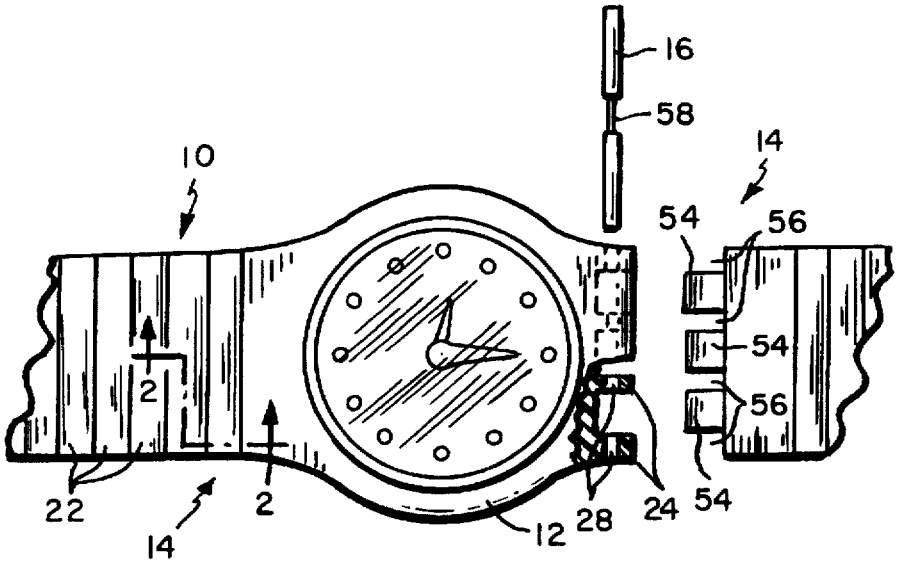
FIG. 1 is a partial top plan view showing a watchband connected to one end of a plastic watch case by means of an end connector in accordance with the present invention, and showing the opposite end of the watchband uncoupled from the watch case.
Figure 2:
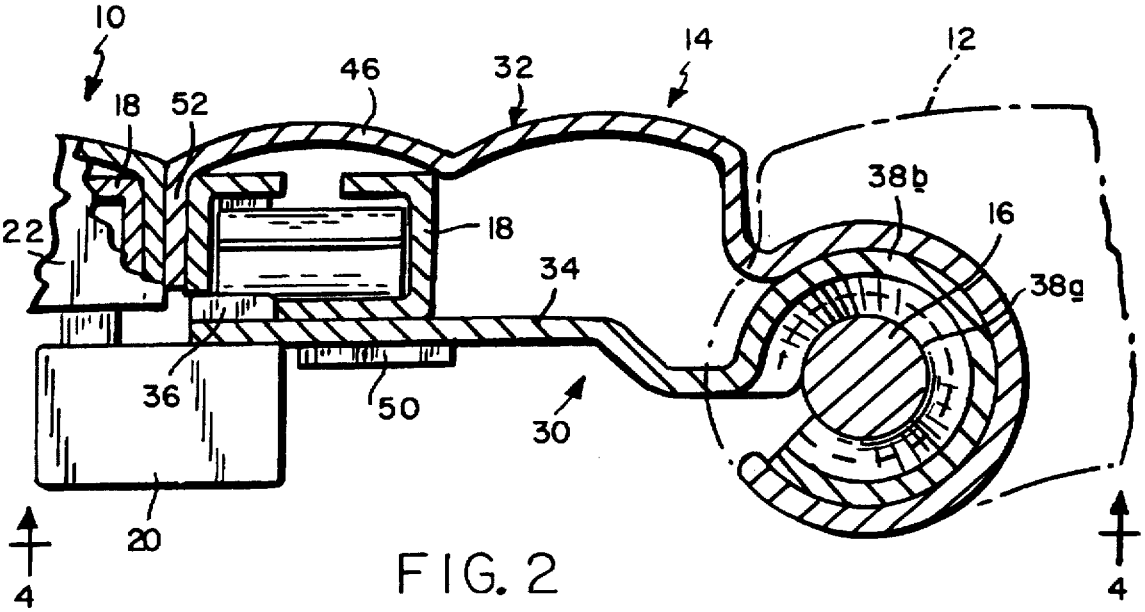
FIG. 2 is a sectional view on an enlarged scale taken along line 2—2 of FIG. 1.

Referring initially to FIGS. 1–5, one end of an expansible watchband 10 is shown coupled to a plastic watch case 12 by means of an end connector assembly 14 in accordance with the present invention. The end connector assembly at the opposite end of the band is shown uncoupled from the watch case as a result of the extraction of a metallic cross pin 16.

The watchband 10 is of the conventional type, having rows of top links 18 connected to rows of bottom links 20 by U-shaped staples and internal springs (not shown) in a manner well known to those skilled in the art. With the exception of the terminal top link 18, all of the other top links are covered by decorative metallic top shells 22.

The watch case 12 has lugs 24 separated by sockets 26. Aligned apertures 28 extend through the lugs 24 in a direction transverse to the length of the watchband.

The end connector 14 is comprised of a bottom component 30 and a top component 32. Bottom component 30 has a planar rear end 34 with an upwardly projecting tooth 36, and a front end with mutually spaced projections 38, 40. At least the two projections 38 on either side of the center projection 40 define hollow substantially cylindrical guides. The projections 38 have reduced diameter central wall portions **38*a* located between and joined to enlarged diameter end wall portions 38*b* by intermediate conical sections 38c. The central projection 40 is only partially cylindrical and is configured to be resiliently deflectable. Projection 40 also has a reduced diameter central wall portion 40*a* located between and joined to enlarged diameter end wall portions 40*b* by intermediate conical sections 40*c***.

Figure 6:
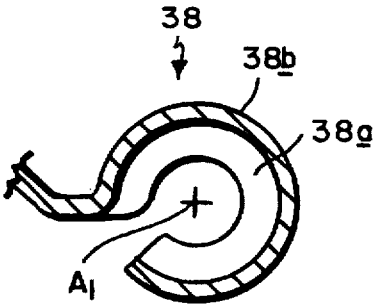
FIGS. 6 and 7 are sectional views on an enlarged scale taken respectively on lines 6—6 and 7—7 of FIG. 3.
Figure 7:
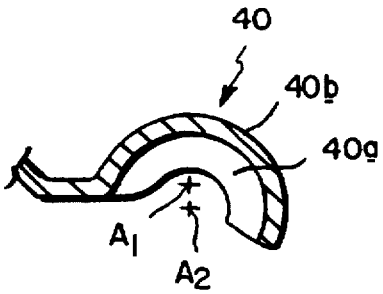
Figure 3:
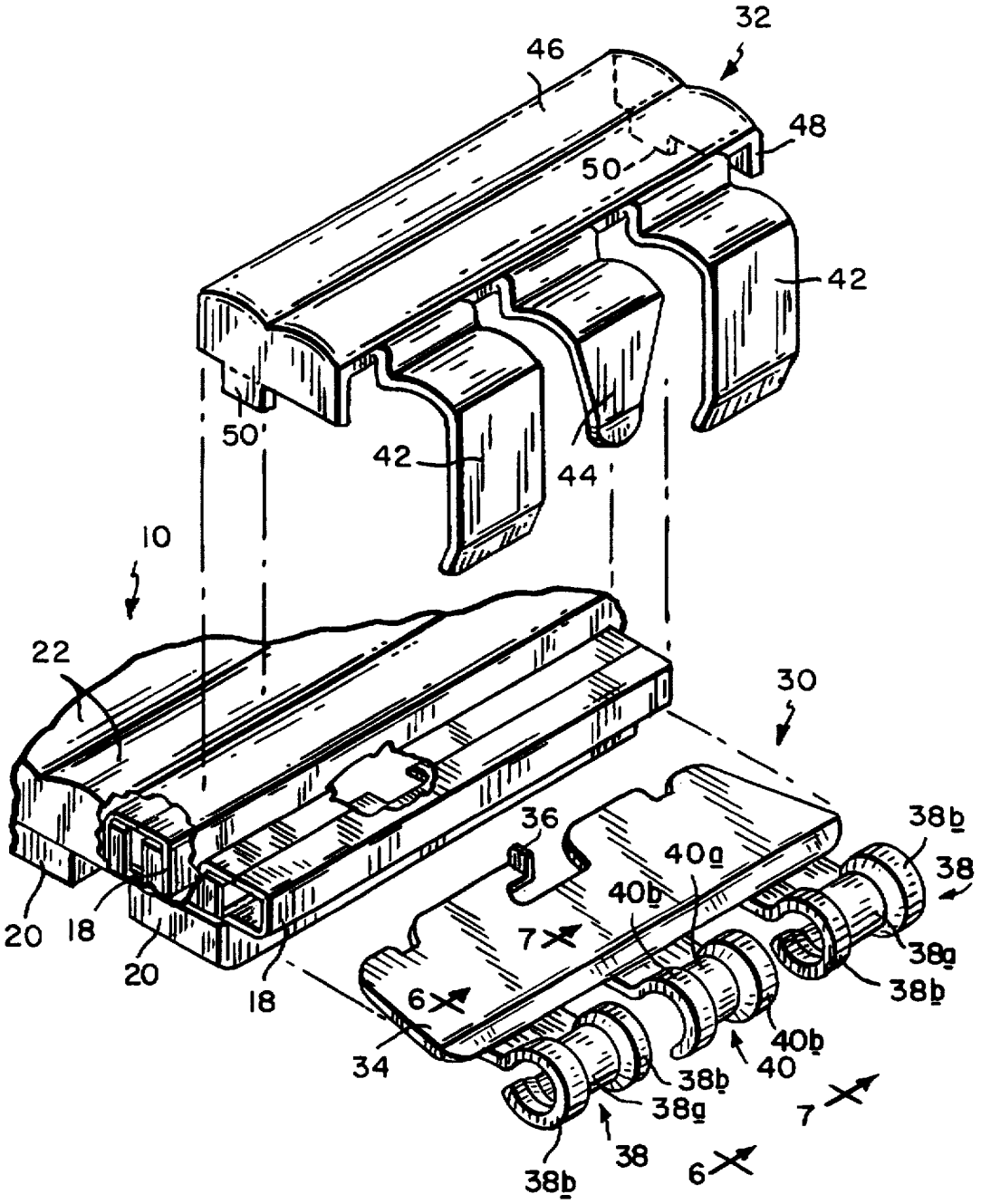
FIG. 3 is an exploded three-dimensional view of the end connector showing the bottom and top components adjacent to one end of the watchband.
Figure 4:
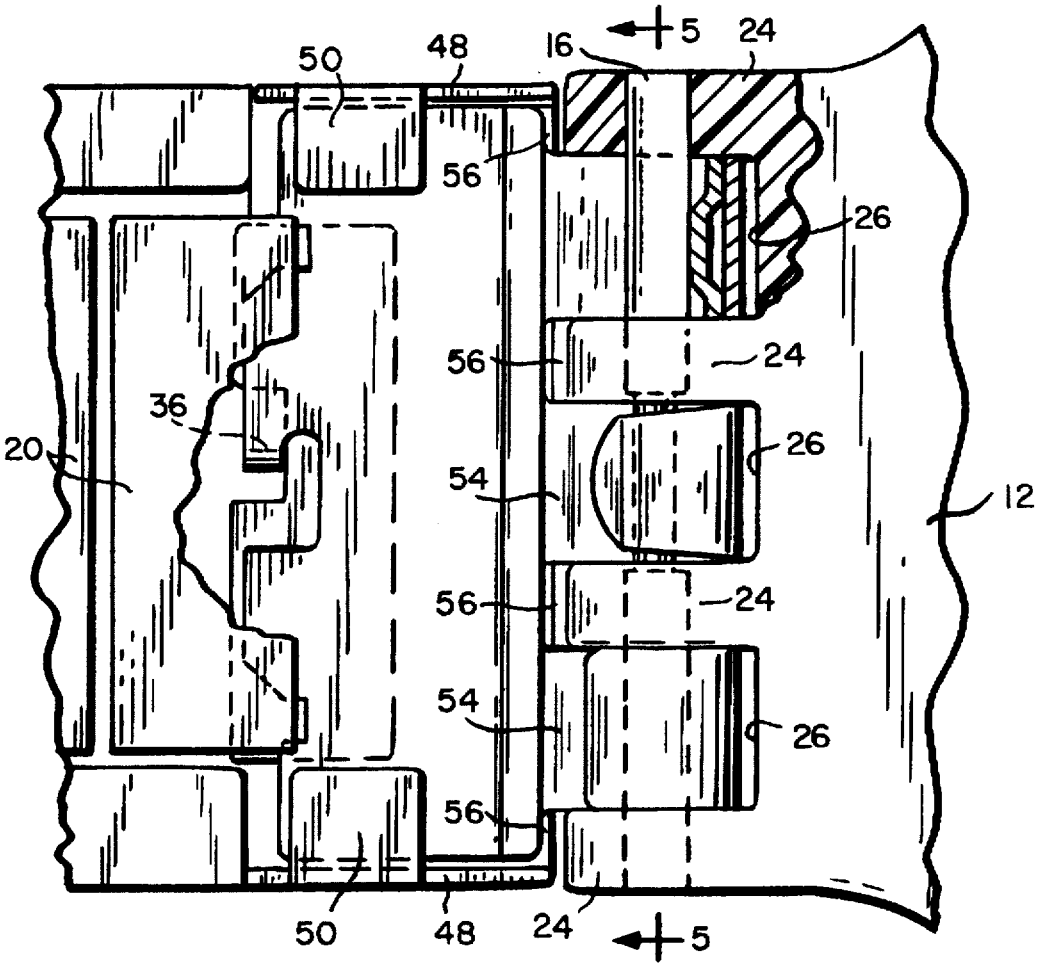
FIG. 4 is an enlarged bottom view with portions broken away of the end connector joined to the watch case.
Figure 5:
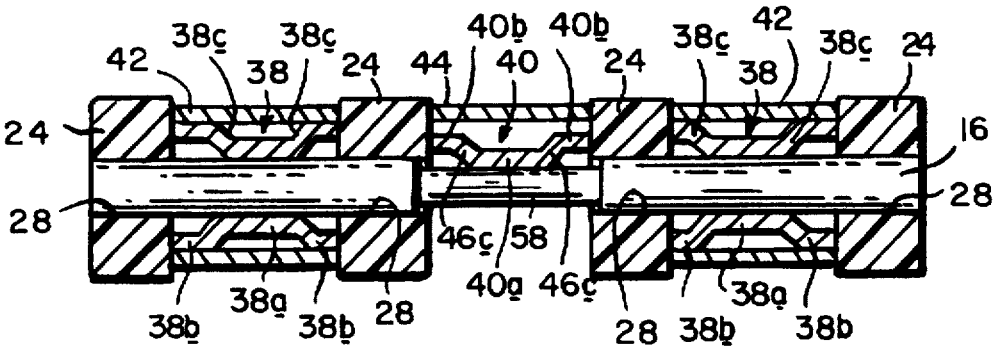
FIG. 5 is a sectional view taken along line 5—5 of FIG. 4.

It will be seen from FIG. 6 that the wall portions **38*a* and 38*b* of projections 38 have a common central axis $A_1$. As shown in FIG. 7, the wall portions 40*a* and 40*b* of central projection 40** have a common axis $A_2$, with axis $A_2$ being offset from axis $A_1$.

The top component 32 has a from end with mutually spaced flanges 42, 44 and a box-shape rear end defined by a top wall 46, side walls 48 with depending tabs 50, and a rear wall 52. The top wall 46 is configured and dimensioned to provide a continuation of the decorative appearance provided by the top shells 22 applied to the top links 18.

During assembly of the end connector, the planar rear end 34 of the bottom component 30 is first inserted beneath the terminal top link 18. The tooth 36 of the bottom component is engaged in a notch 60 on the underside of the terminal top link. The top component 32 is then assembled onto the bottom component 30. The flanges 42, 44 are bent respectively around the projections 38, 40 to thereby form second lugs 54 separated by second sockets 56 (see FIGS. 1 and 4). The rear wall 52 of the top component is located behind and in engagement with the terminal top link 18, the latter being firmly captured between the top wall 46 of the top component and the planar rear end 34 of the bottom component. The tabs 50 are bent under the planar rear end 34 to complete the assembly.

The end connector 14 is attached to the watch case 12 in the following manner: the second lugs 54 of the end connector are located in the sockets 26 of the watch case, with the lugs 24 of the watch case being located in the sockets 56 of the end connector. The metallic pin 16 then inserted through the apertures 28 of the watch case lugs 24 and the tubular guides provided by the projections 38 of the bottom component 30. The pin 16 has a reduced diameter middle section 58. As the pin progresses through the assembly, the center projection 40 on the bottom component is momentarily deflected, placing its axis $A_2$ in alignment with the axis $A_1$ of the projections 38. This momentary deflection persists until the reduced diameter segment 58 comes into alignment with the central projection 40, at which point the central projection 40 snaps into the reduced diameter pin segment 58, thereby establishing a mechanical interengagement which resists any tendency on the part of the pin 16 to work its way out of the assembled combination.

In light of the foregoing, it will now be understood that prior to being connected to the watch case, and after being assembled onto the end of the watchband, the end connector of the present invention can be subjected along with the watchband to PVD coating without suffering the deleterious effects of plastic components. The resulting reduction in the number of components making up the connector reduces overall costs and simplifies assembly procedures. All this is achieved while still providing a reliable means for retaining the connecting pin in its inserted position following assembly of the watchband onto the plastic watch case.

It will be understood that the end connector of the present invention is not restricted in use to expansible watchbands. For example, non-expansible watchbands having links interconnected by pins or the like could be joined to a watch case with the same end connector assembly.

I claim:

1. A connector for joining an end of an expansible watch band to a watch case, the end of said watchband having a terminal top link, the watch case having first lugs separated by first sockets, with aligned apertures extending through said first lugs, said connector comprising:

a metal bottom component having a front end and a rear end, the rear end of said bottom component being configured to underlie said terminal top link, the front end of said bottom component having mutually spaced projections, at least two of said projections defining hollow guides;

a metal top component having a front end and a rear end, the rear end of said top component being configured to overlie the rear end of said bottom component and to capture said terminal top link therebetween, the front end of said top component having mutually spaced flanges aligned with and bent onto and around the projections on said bottom component to form second lugs separated by second sockets;

means for fixedly interconnecting said top component to said bottom component, said first and second lugs being adapted to be received respectively in said second and first sockets, with said hollow guides aligned with said apertures; and a pin axially inserted through said aligned hollow guides and apertures to establish a pivotal connection between said watch case and said end connector, said hollow guides having reduced diameter portions contacting said pin and enlarged diameter portions contacting said flanges.

2. The connector as claimed in claim 1 further comprising means on said bottom component for mechanically engaging said terminal top link.

3. The connector as claimed in claims 1 or 2 further comprising means on said top component for mechanically engaging said terminal top link.

4. The connector as claimed in claim 1 wherein at least one of said projections comprises a spring member resiliently contacting said pin.

5. The connector as claimed in claim 4 wherein said pin has a reduced diameter portion mechanically interengaged by said spring member.

6. A connector for joining an end of an expansible watch band to a watch case, the end of said watchband having a terminal top link, the watch case having first lugs separated by first sockets, with aligned apertures extending through said first lugs, said connector comprising:

a metal bottom component having a front end and a rear end, the rear end of said bottom component being configured to underlie said terminal top link, the front end of said bottom component having mutually spaced projections, at least one of said projections being a spring member and at least two other of said projections defining hollow guides;

a metal top component having a front end and a rear end, the rear end of said top component being configured to overlie the rear end of said bottom component and to capture said terminal top link therebetween, the front end of said top component having mutually spaced flanges aligned with and bent onto and around the projections on said bottom component to form second lugs separated by second sockets;

means for fixedly interconnecting said top component to said bottom component, said first and second lugs being adapted to be received respectively in said second and first sockets, with said hollow guides aligned with said apertures; and a pin axially inserted through said aligned guides and apertures to establish a pivotal connection between said watch case and said end connector, said pin having a reduced diameter portion mechanically interengaged by said spring member.

7. The connector as claimed in claim 6, wherein said hollow guides have reduced diameter portions contacting said pin and enlarged diameter portions contacting said flanges.

* * * * *